US006067967A

United States Patent [19]

Kidokoro et al.

[11] Patent Number: 6,067,967

[45] Date of Patent: May 30, 2000

[54] FUEL RESERVING DEVICE

[75] Inventors: Toru Kidokoro, Hadano; Takaaki Ito, Mishima, both of Japan

[73] Assignee: Toyota Jidosha Kabushiki Kaisha, Toyota, Japan

[21] Appl. No.: 09/044,025

[22] Filed: Mar. 19, 1998

[30] Foreign Application Priority Data

Mar. 21, 1997 [JP] Japan ..... 9-068113

[51] Int. Cl.[7] ..... F02M 33/04

[52] U.S. Cl. ..... 123/516; 123/514; 123/518

[58] Field of Search ..... 123/516, 518, 123/519, 520, 521, 514, 541

[56] References Cited

U.S. PATENT DOCUMENTS

| | | | |
|---|---|---|---|
| 4,829,968 | 5/1989 | Onufer | 123/518 |
| 5,275,145 | 1/1994 | Tuckey | 123/521 |
| 5,584,279 | 12/1996 | Brunnhofer | 123/541 |
| 5,711,282 | 1/1998 | Lang et al. | 123/514 |

FOREIGN PATENT DOCUMENTS

| | | |
|---|---|---|
| 7-103084 | 4/1995 | Japan . |
| 7-293366 | 11/1995 | Japan . |
| 8-121279 | 5/1996 | Japan . |
| 8-121280 | 5/1996 | Japan . |

*Primary Examiner*—Thomas N. Moulis
*Attorney, Agent, or Firm*—Oliff & Berridge, PLC

[57] ABSTRACT

According to the present invention, there is provided a fuel reserving device for reserving fuel therein. The device comprises a fuel tank for reserving fuel therein, and a fuel vapor tank for reserving fuel vapor therein. The fuel vapor is fed from said fuel tank to said fuel vapor tank and returned from said fuel vapor tank to said fuel tank. The fuel vapor is not returned from said fuel vapor tank to said fuel tank when a pressure in said fuel tank would be higher than a predetermined pressure if the fuel vapor was returned from said fuel vapor tank to said fuel tank.

12 Claims, 15 Drawing Sheets

FUEL RESERVING DEVICE

BACKGROUND OF THE INVENTION

1. Field of the invention

The invention relates to a fuel reserving device.

2. Description of the Related Art

Before fuel is fed to a tank for holding fuel, a cap for closing an inlet of the fuel tank is removed therefrom. When the cap is removed, fuel vapor may be discharged from the fuel tank to the atmosphere via the inlet.

In order to avoid discharging the fuel vapor, Japanese Unexamined Patent Publication No. 8-121279 discloses a device for preventing fuel vapor from being discharged from a fuel tank to the atmosphere. The device comprises a reservoir connected to the fuel tank via a pipe and a compressor arranged in the pipe. In order to avoid discharging the fuel vapor from the fuel tank to the atmosphere, when the pressure in the fuel tank is higher than a predetermined pressure before the fuel is fed to the fuel tank, the compressor is activated to feed the fuel vapor from the fuel tank to the reservoir to decrease the pressure in the fuel tank. Then the fuel is fed to the fuel tank.

Further, in the above device, the reservoir communicates with the fuel tank after the feeding of the fuel is completed. The pressure in the reservoir is relatively high since the fuel vapor is fed from the fuel tank to the reservoir by the compressor. Therefore, the pressure in the fuel tank becomes relatively high after the reservoir communicates with the fuel tank. Thus, the fuel tank needs a relatively high durability to withstand the high pressure and this leads to high manufacturing costs.

Therefore, the object of the invention is to provide a fuel reserving device which prevents fuel vapor from being discharged therefrom to the atmosphere while the device needs a relatively low durability.

SUMMARY OF THE INVENTION

According to the invention, there is provided a fuel reserving device for reserving fuel therein comprising a fuel tank for reserving fuel therein, a fuel vapor tank for reserving fuel vapor therein, fuel vapor feeding means for feeding the fuel vapor from the fuel tank to the fuel vapor tank, fuel vapor returning means for returning the fuel vapor from the fuel vapor tank to the fuel tank, and control means for controlling an operation of the fuel vapor returning means to stop returning the fuel vapor from the fuel vapor tank to the fuel tank when the control means judges that a pressure in the fuel tank would be higher than a predetermined pressure if the fuel vapor returning means returned the fuel vapor from the fuel vapor tank to the fuel tank.

Further, according to the invention, the control means controls an operation of the fuel vapor feeding means to feed the fuel vapor from the fuel tank to the fuel vapor tank when the fuel vapor should be fed from the fuel tank to the fuel vapor tank, and an operation of the fuel vapor returning means to return the fuel vapor from the fuel vapor tank to the fuel tank when the fuel vapor should be returned from the fuel vapor tank to the fuel tank.

Further, according to the invention, the control means controls to make the fuel vapor feeding means feed the fuel vapor from the fuel tank to the fuel vapor tank when the fuel is fed to the fuel tank, and to make the fuel vapor returning means return the fuel vapor from the fuel vapor tank to the fuel tank when the fuel has been fed to the fuel tank.

Further, according to the invention, the fuel vapor feeding means comprises a fuel vapor feeding pipe for connecting the fuel tank to the fuel vapor tank and a fuel vapor feeding control valve arranged in the fuel vapor feeding pipe, the fuel vapor returning means comprises a fuel vapor returning pipe for connecting the fuel vapor tank to the fuel tank and a fuel vapor returning control valve arranged in the fuel vapor returning pipe, and the control means opens the fuel vapor feeding control valve and closes the fuel vapor returning control valve when fuel is fed to the fuel tank, and closes the fuel vapor feeding control valve and opens the fuel vapor returning control valve when the fuel has been fed to the fuel tank.

Further, according to the invention, the fuel vapor feeding means comprises a compressor arranged in the fuel vapor feeding pipe to feed the fuel vapor from the fuel tank to the fuel vapor tank under a pressure.

Further, according to the invention, pressure sensing means in provided for sensing at least one of the pressures in the fuel tank and the fuel vapor tank, and the control means judges that the pressure in the fuel tank would be higher than the predetermined pressure if the fuel vapor returning means returned the fuel vapor from the fuel vapor tank to the fuel tank on the basis of the pressure sensed by the pressure sensing means.

Further, according to the invention, the pressure sensing means comprises a fuel tank pressure sensor for sensing the pressure in the fuel tank and a fuel vapor tank pressure sensor for sensing the pressure in the fuel vapor tank.

Further, according to the invention, fuel sensing means is provided for sensing the fuel in the fuel vapor tank, the fuel vapor returning means returns the fuel vapor in the fuel vapor tank to the fuel tank when the fuel sensing means senses the fuel in the fuel vapor tank and the pressure sensing means senses that the pressure in the fuel vapor tank is higher than the pressure in the fuel tank.

Further, according to the invention, pressure increasing means is provided for increasing the pressure in the fuel vapor tank when the fuel sensing means senses the fuel in the fuel vapor tank and the pressure sensing means senses that the pressure in the fuel vapor tank is lower than the pressure in the fuel tank.

Further, according to the invention, temperature increasing means is provided for increasing the temperature in the fuel vapor tank when the fuel sensing means senses the fuel in the fuel vapor tank and the pressure sensing means senses that the pressure in the fuel vapor tank is lower than the pressure in the fuel tank.

Further, according to the invention, cooling means is provided for cooling at least one of the fuel vapor tank and the fuel tank when the control means judges that the pressure in the fuel tank would be higher than the predetermined pressure if the fuel vapor returning means returned the fuel vapor from the fuel vapor tank to the fuel tank.

Further, according to the invention, purging means is provided for purging the fuel vapor from the fuel vapor tank to an engine when the control means judges that the pressure in the fuel tank would be higher than the predetermined pressure if the fuel vapor returning means returned the fuel vapor from the fuel vapor tank to the fuel tank.

The present invention may be more fully understood from the description of the preferred embodiments of the invention set forth below, together with the accompanying drawings.

DESCRIPTION OF THE PREFERRED EMBODIMENTS

A fuel reserving device according to the first embodiment of the invention will be explained below.

Figure 1:
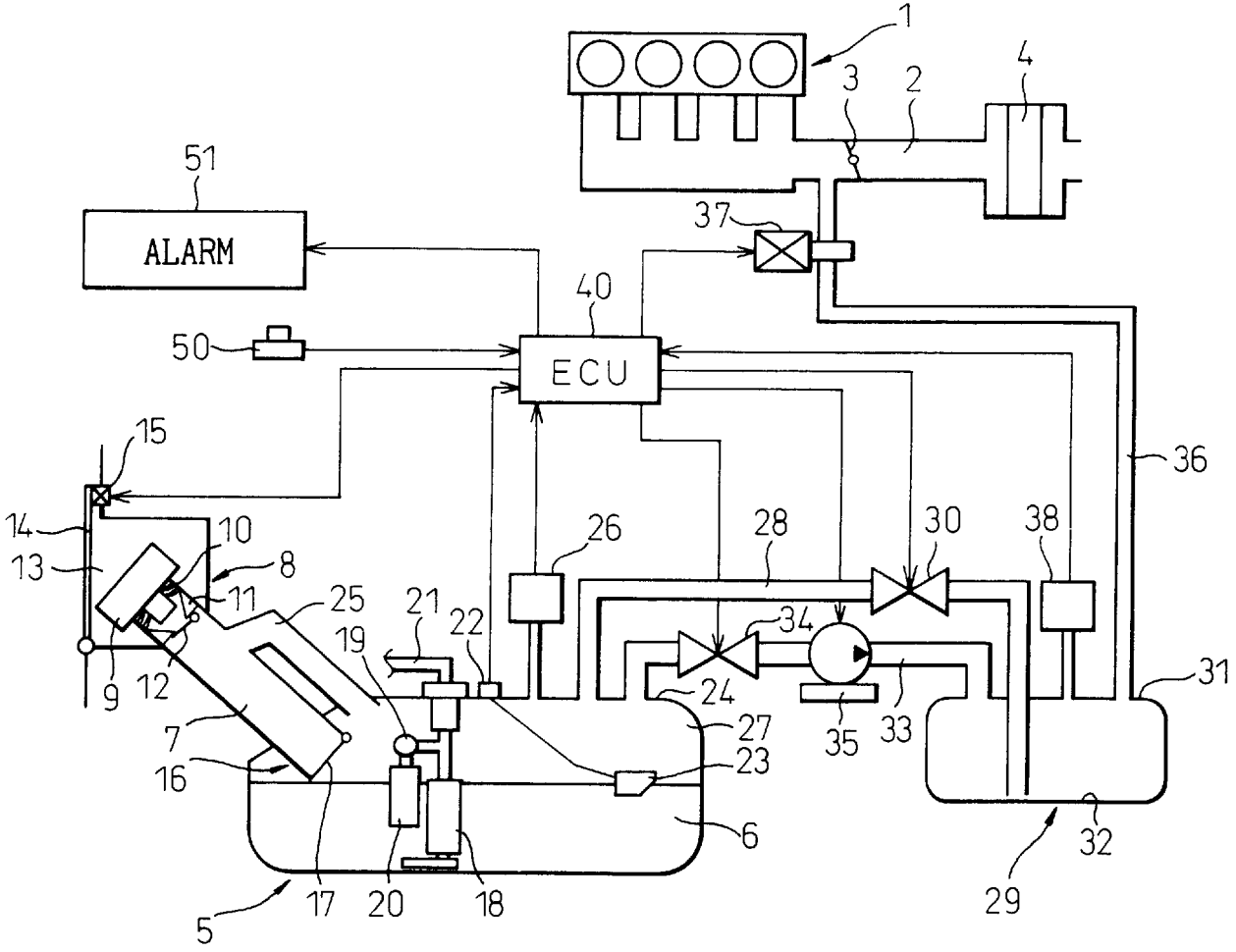
FIG. 1 is a view of a fuel reserving device according to the first embodiment of the invention.

Referring to FIG. 1, reference number 1 is a body of an engine, 2 is an intake passage of the engine to feed an intake air to the engine body 1, 3 is a throttle valve positioned in the intake passage 2 to control an amount of the intake air fed to the engine body 1, and 4 is an air filter positioned in the intake passage 2 upstream of the throttle valve 3 to filter the intake air. Note that the word upstream is associated with the direction of the intake air in the intake passage.

In FIG. 1, 5 is a fuel tank comprised of a material such as metal or synthetic resin. The tank 5 includes a fuel chamber 6 formed therein. The fuel chamber 6 is sealingly connected to a fuel feeding pipe 7. A fuel feeding pipe cap 9 is removably attached to an upper opening 8 of the fuel feeding pipe 7. A sealing member 10 for contacting with an peripheral face of the cap 9, a sealing member 11 for contacting with an peripheral face of a fuel feeding nozzle (not shown) when the nozzle is inserted into the fuel feeding pipe 7 to feed fuel to the fuel chamber 6, and an upper fuel vapor shut-off valve 12 for normally shutting off the fuel feeding pipe 7 by a biasing force of a spring (not shown) are attached to an inner wall of the fuel feeding pipe 7 adjacent to the upper opening 8 of the fuel feeding pipe 7.

The upper opening 8 of the fuel feeding pipe 7 is housed in a fuel feeding chamber 13 which is closed by a fuel feeding chamber closure 14. The closure 14 is connected to a closure opener 15. When the opener 15 is activated, the closure 14 is opened.

A lower opening 16 of the fuel feeding pipe 7 is positioned in the fuel chamber 6. A lower fuel vapor shut-off valve 17 for normally shutting off the fuel feeding pipe 7 by a biasing force of a spring (not shown) is positioned on a lower opening 16 of the fuel feeding pipe 7.

Further, a fuel pump 18, a fuel pressure regulator 19 and a fuel filter 20 are arranged in the fuel chamber 6. The pressure of the fuel pumped by the pump 18 is regulated by the regulator 19. Then, the fuel is fed to fuel injectors (not shown) via a fuel supplying pipe 21. Since the regulator 19 is arranged in the fuel chamber 6, it is not necessary to arrange a fuel return passage for relieving the pressure of the fuel, which fuel return passage extends to the fuel tank 5 from a fuel dispensing pipe for dispensing fuel from the fuel supplying pipe 21 to each injector. Further, since the fuel which is heated adjacent to a cylinder head to high temperature is not returned to the fuel tank 5, the production of a fuel vapor in the fuel chamber 6 is restricted. Moreover, since the fuel which includes a fuel vapor due to the heating of the fuel adjacent to the cylinder head is not returned to the fuel tank 5, the amount of the fuel vapor in the fuel chamber 6 is kept small. Further, since the pump 18 is arranged in the fuel tank 5, the noise derived from the pump 18 to the outside of the fuel tank 5 is kept small.

A fuel level sensor 22 is arranged in the fuel tank 5 to sense a level of the fuel in the fuel chamber 6. The fuel level sensor 22 has a float 23 which floats on the fuel in the fuel chamber 6. The float 23 moves up and down according to the movement of the fuel in the fuel chamber 6. The fuel level sensor 22 senses the amount of the movement of the float 23.

A recirculation pipe 25 is arranged on an upper wall 24 of the fuel tank 5. One end of the recirculation pipe 25 is open into the fuel chamber 6 and the other end thereof is open into the fuel feeding pipe 7. When the fuel is fed to the fuel chamber 6, the air above the surface of the fuel in the fuel chamber 6 is forced to flow to the fuel feeding pipe 7 via the recirculation pipe 25. Therefore, the fuel can be smoothly fed to the fuel chamber 6.

A fuel tank pressure sensor 26 is arranged on the upper wall 24 of the fuel tank 5 to sense the pressure in the fuel tank 5.

An upper space 27 of the fuel chamber 6 is in communication with a fuel vapor tank or reservoir tank 29 via a fuel vapor returning pipe 28. A fuel vapor returning control valve 30 is arranged in the fuel vapor returning pipe 28 to shut off the fuel vapor returning pipe 28. The fuel vapor returning control valve 30 is opened when the fuel vapor should be returned from the fuel vapor tank 29 to the fuel tank 5. The fuel vapor returning control valve 30 extends into the fuel vapor tank 29 from an upper wall 31 of the fuel vapor tank 29 and is open in the vincity of a bottom wall 32 of the fuel vapor tank 29.

Further, the upper space 27 of the fuel chamber 6 is in communication with the fuel vapor tank 29 via a fuel vapor feeding pipe 33. A fuel vapor feeding control valve 34 is arranged in the fuel vapor feeding pipe 33 to is shut off the fuel vapor feeding pipe 33. The fuel vapor feeding control valve 34 is opened when the fuel vapor should be fed from the fuel tank 5 to the fuel vapor tank 29. Moreover, a compressor 35 is arranged in the fuel vapor feeding pipe 33 at the fuel vapor tank side of the fuel vapor feeding control valve 34 to feed the fuel vapor from the fuel tank 5 to the fuel vapor tank 29 under a pressure.

A fuel vapor purge pipe 36 is arranged on the upper wall 31 of the fuel vapor tank 29. The fuel vapor tank 29 is in communication with the intake passage 2 via the fuel vapor purge pipe 36. A purging control valve 37 is arranged in the fuel vapor purging pipe 36 to shut off the fuel vapor purge pipe 36. The purging control valve 37 is opened when the fuel vapor should be purged from the fuel vapor tank 29 to the intake passage 2 of the engine. The amount of the fuel vapor purged to the intake passage 2 is controlled by controlling the operation of the purging control valve 37.

The fuel vapor is purged to the intake passage 2 on the basis of the condition of the engine such as an engine load in the manner that the driving condition of the engine is kept stable and the emission of the engine is kept clean.

A fuel vapor tank pressure sensor 38 is arranged on the upper wall 31 of the fuel vapor tank 29 to sense a pressure in the fuel vapor tank 29.

The fuel reserving device according to the first embodiment comprises an electronic control unit (ECU) 40. The fuel tank and fuel vapor tank pressure sensors 26 and 38 and an opening switch 50 are connected to the ECU 40. Further, the ECU 40 is connected to the purge control valve 37, the opener 15, the fuel vapor feeding control valve 34, the compressor 35, the fuel vapor returning control valve 30 and an alarm 51.

Figure 2:
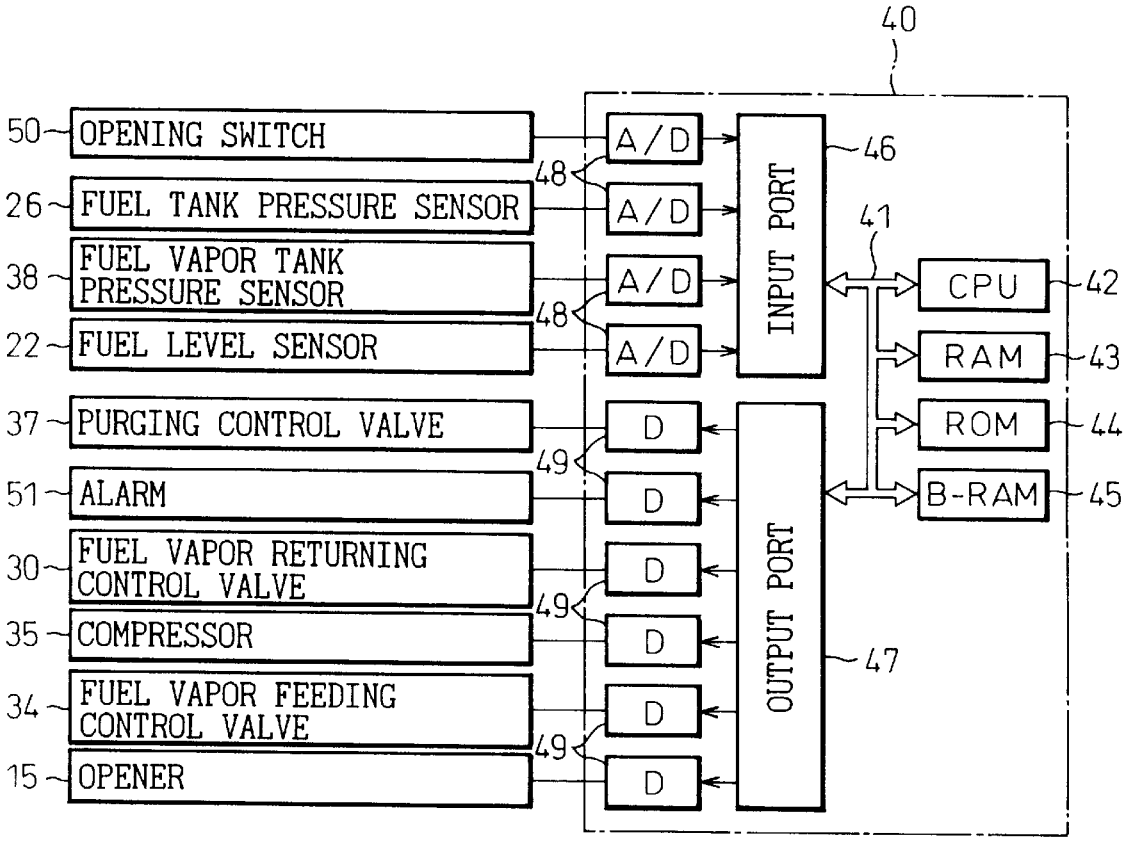
FIG. 2 is a view of the ECU of FIG. 1.

The ECU according to the first embodiment will be explained in detail, referring to FIG. 2. The electronic is control unit (ECU) 40 is a digital computer and comprises a central processing unit (CPU) 42, a random access memory (RAM) 43, a read only memory (ROM) 44, a back-up RAM (B-RAM) 45, an input port 46 and an output port 47. These components of the ECU are interconnected by a bidirectional bus 41. The opening switch 50, the fuel tank and fuel vapor tank pressure sensors 26 and 38 and the fuel level sensor 22 are connected via corresponding A-D converters 48. The output port 47 is connected to the purging control valve 37, the alarm 51, the fuel vapor returning control valve 30, the compressor 35, the fuel vapor feeding control valve 34 and the opener 15 via corresponding drives 49.

A fuel feeding operation and a post-fuel-feeding-operation process in the fuel reserving device according to the first embodiment of the invention will be explained below.

In the fuel feeding operation according to the first embodiment, before fuel is fed to the fuel chamber 6, it is judged if the pressure in the fuel tank 5, sensed by the fuel tank pressure sensor 26, is lower than the atmospheric pressure. According to the first embodiment, in order to avoid discharging the fuel vapor from the fuel tank to the atmosphere, when the pressure in the fuel tank 5 is lower than the atmospheric pressure, the closure 14 is opened to allow the fuel to be fed to the fuel chamber 6. Therefore, when the pressure in the fuel tank 5 is equal to or higher than the atmospheric pressure, the pressure in the fuel tank 5 is forced to become lower than the atmospheric pressure.

The fuel feeding operation according to the first embodiment of the invention will be explained in detail.

In the first embodiment, when the opening switch 50 is activated to open the closure 14, it is judged if the pressure in the fuel tank 5 is lower than the atmospheric pressure. When the pressure in the fuel tank 5 is equal to or higher than the atmospheric pressure, the fuel is vapor returning control valve 30 is closed and the fuel vapor feeding control valve 34 is opened. Then, the compressor 35 is activated to make the pressure in the fuel tank 5 lower than the atmospheric pressure. When the pressure in the fuel tank 5 becomes lower than the atmospheric pressure, the compressor 35 is stopped, the fuel vapor feeding control valve 34 is closed. Then, the closure 14 is opened to allow the fuel to be fed to the fuel chamber 6.

After the closure 14 is opened, the cap 9 is removed from the upper opening 8 of the fuel feeding pipe 7. When the cap 9 is removed, the upper and lower fuel vapor shut-off valves 12 and 17 are kept closed to avoid the discharging the fuel vapor from the fuel tank 5 to the atmosphere.

Next, a fuel feeding nozzle is inserted into the fuel feeding pipe 7 and opens the upper fuel vapor shut-off valve 12 against the biasing force of the spring. When-the fuel feeding nozzle is inserted, the peripheral face of the nozzle is in contact with the sealing member 11. Therefore, the leakage of the fuel vapor from the fuel tank 5 to the atmosphere is restricted.

Next, the fuel is fed to the fuel chamber 6 via the fuel feeding pipe 7. The fuel fed from the fuel feeding nozzle opens the lower fuel vapor shut-off valve 17 against the biasing force of the spring.

When the fuel is fed to the fuel chamber 6, the pressure in the fuel tank 5 is increased according to the increasing of the fuel and the production of the fuel vapor in the fuel chamber 6. When the fuel tank pressure sensor 26 senses that the pressure in the fuel tank 5 becomes equal to or higher than the atmospheric pressure, the compressor 35 is activated again, and the fuel vapor feeding control valve 34 is opened to keep the pressure in the fuel chamber 6 lower than the atmospheric pressure. Therefore, according to the first embodiment, the leakage of the fuel vapor from the fuel tank to the atmosphere during the fuel feeding operation is restricted. Further, according to the first embodiment, since the pressure in the fuel tank 5 is kept lower than the atmospheric pressure during the fuel feeding operation, the fuel is smoothly fed to the fuel chamber 6 from the fuel feeding nozzle.

Note that the compressor 35 is stopped when the pressure in the fuel vapor tank 29 exceeds a predetermined fuel vapor tank pressure which is lower than an acceptable pressure which the fuel vapor tank 29 can withstand.

A negative pressure is produced around the fuel feeding nozzle. When the surface of the fuel in the fuel chamber 6 reaches the lower opening 16 of the recirculation pipe 25 to shut off the latter, the negative pressure around the fuel feeding nozzle is increased. When the nozzle senses the increased negative pressure, the nozzle stops feeding the fuel. Therefore, the maximum amount of the fuel reserved in the fuel tank 5 depends on the position of the lower opening 16 of the recirculation pipe 25. According to the first embodiment, the lower opening 16 of the recirculation pipe 25 is positioned at the upper wall 24 of the fuel tank 5. Therefore, the fuel tank 5 is generally fully filled with the fuel.

When the nozzle stops feeding the fuel, the lower fuel vapor shut-off valve 17 is closed by the biasing force of the spring.

After the nozzle stops feeding the fuel, the nozzle is withdrawn from the fuel feeding pipe 7 and then, the upper fuel vapor shut-off valve 12 is closed by the biasing force of the spring. Next, the cap 9 is attached to the upper opening 8 of the fuel feeding pipe 7, and the closure 14 is closed.

The post-fuel-feeding-operation process according to the first embodiment will be explained below.

If the fuel vapor returning control valve 30 is opened to return the fuel vapor from the fuel tank 5 to the fuel vapor tank 29 after the fuel feeding operation is completed, the pressure in the fuel vapor tank 29 increases the pressure in the fuel tank 5. If the pressure in the fuel tank 5 becomes higher than the acceptable maximum pressure of the fuel tank 5, the fuel tank 5 will be broken. Therefore, according to the first embodiment, before the fuel vapor is returned from the fuel vapor tank 29 to the fuel tank 5, it is judged if the pressure (hereinafter, referring to as "resulting pressure") in the fuel tank 5 would be lower than a predetermined fuel tank pressure which is lower than an acceptable pressure which the fuel tank 5 can withstand if the fuel vapor was returned from the fuel vapor tank 29 to the fuel tank 5. When the resulting pressure in the fuel tank 5 would be higher than the predetermined fuel tank pressure, the fuel vapor returning control valve 30 is kept closed until the resulting pressure in the fuel tank 5 would be lower than the predetermined fuel tank pressure.

According to the first embodiment, the pressure in the fuel tank 5 is kept relatively low. Therefore, the fuel tank 5 needs a relative lower strength. Note that the resulting pressure in the fuel tank 5 is calculated on the basis of the pressure in the fuel tank 5, the pressure in the fuel vapor tank 29, the volume of the upper space 27 of the fuel chamber 6 and the volume of the fuel vapor tank 29. The volume of the upper space 27 of the fuel chamber 6 is calculated on the basis of the fuel level sensed by the fuel level sensor 22 and the volume of the fuel chamber 6.

In the first embodiment, a charcoal canister for adsorbing the fuel vapor may be arranged in the fuel vapor purging pipe 36 between the fuel vapor tank 29 and the purging control valve 37. In this case, the fuel vapor adsorbed on the charcoal canister is discharged to the intake passage 2 on the basis of the driving condition of the engine.

The fuel feeding operation of the fuel reserving device according to the first embodiment of the invention will be explained in more detail, referring to a flowchart of FIGS. 3 to 5.

At step 110, it is judged if the opening switch 50 has been activated. When the opening switch 50 has been activated, the routine proceeds to step 112 where a fuel feeding flag is reset, and the routine proceeds to step 114. The fuel feeding flag is reset when the opening switch 50 is activated, and is set when the fuel feeding operation is completed. On the other band, at step 110, when the opening switch 50 has not been activated, the routine directly proceeds to step 114.

At step 114, it is judged if the fuel feeding flag is reset. When the fuel feeding flag is reset, the routine proceeds to step 116 where the fuel vapor returning control valve 30 is closed, and the routine proceeds to step 118. On the other hand, when the fuel feeding flag is set, the routine proceeds to step 126 where the post-fuel-feeding-operation process is carried out, and the routine is ended.

At step 118, it is judged if a pressure Pft in the fuel tank 5 sensed by the fuel tank pressure sensor 26 is higher than the atmospheric pressure Pa (Pft>Pa). When Pft>Pa, it is judged that the closure 14 should not be opened, and the routine proceeds to step 120. On the other hand, when Pft≦Pa, the routine proceeds to step 128 in FIG. 4 where the closure 14 is opened, and the routine proceeds to step 130.

Figure 3:
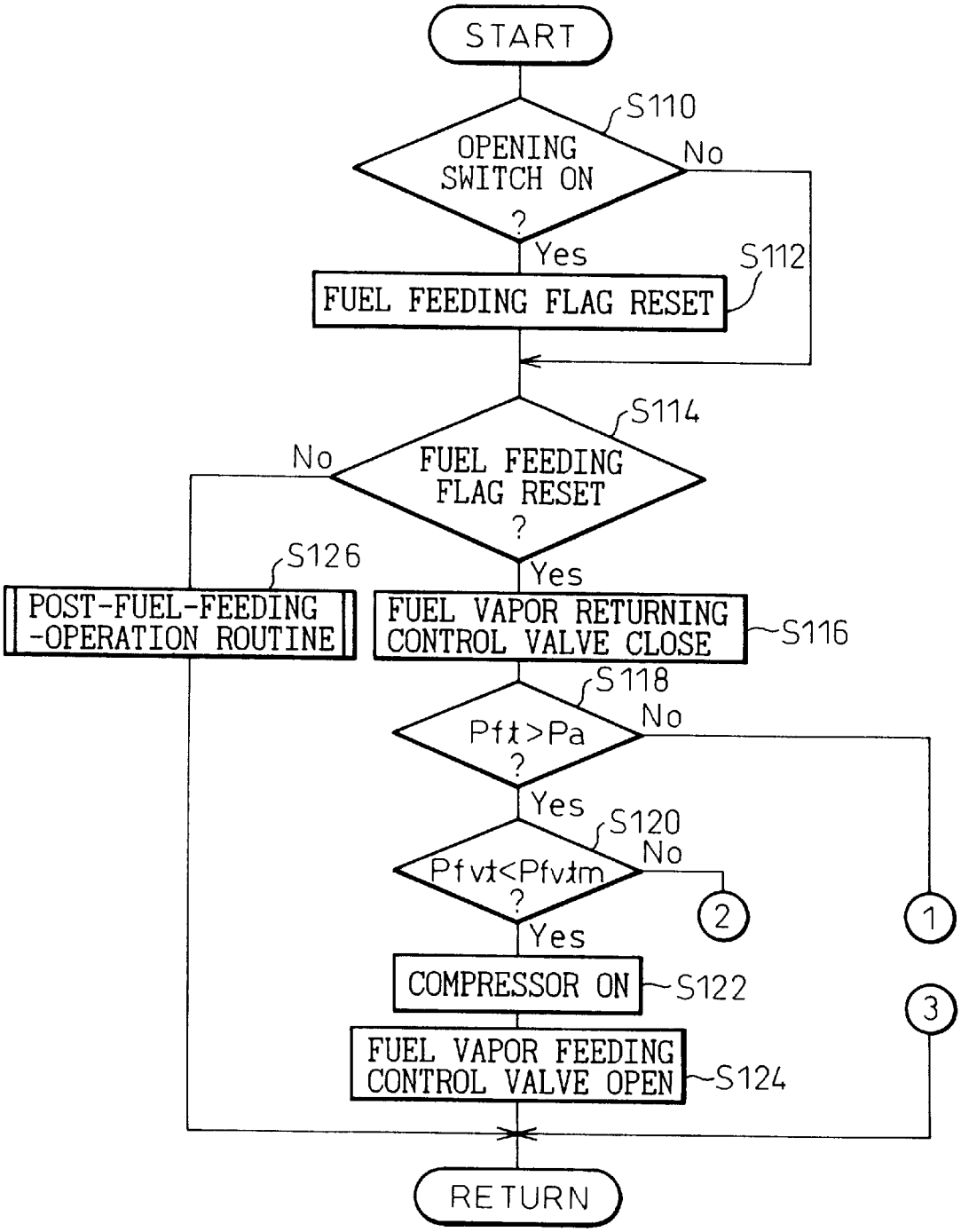
FIG. 3 is a part of a flowchart of the fuel feeding operation in the fuel reserving device according to the first embodiment.

At step 120 in FIG. 3, it is judged if a pressure Pfvt in the fuel vapor tank 29 sensed by the fuel vapor tank pressure sensor 38 is lower than a predetermined fuel vapor tank pressure Pfvtm (Pfvt<Pfvtm). The predetermined fuel tank pressure Pfvtm is lower than the acceptable pressure which the fuel tank 5 can withstand. At step 120, when Pfvt<Pfvtm, the routine proceeds to step 122 where the compressor 35 is activated, the routine proceeds to step 124 where the fuel vapor feeding control valve 34 is opened to decrease the pressure in the fuel tank 5, and the routine is ended. On the other hand, when Pfvt≧Pfvtm, it is judged that the fuel vapor tank could be broken, the routine proceeds to step 140 in FIG. 4 where the fuel vapor feeding control valve is closed, the routine proceeds to step 142 where the compressor 35 is stopped, the routine proceeds to step 144 where the alarm 51 is switched on, and the routine is ended.

Figure 4:
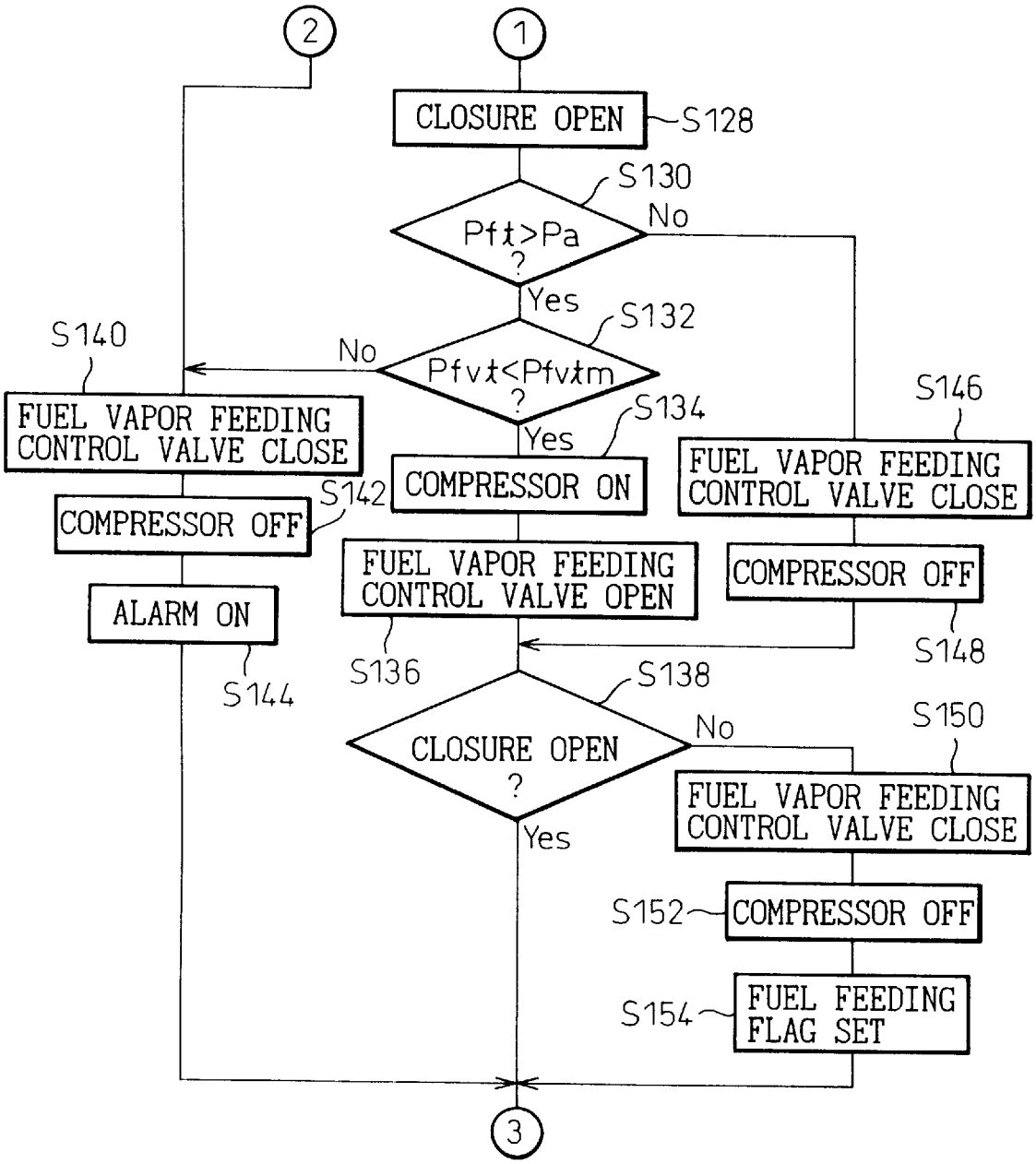
FIG. 4 is a part of a flowchart of the fuel feeding operation in the fuel reserving device according to the first embodiment.
Figure 5:
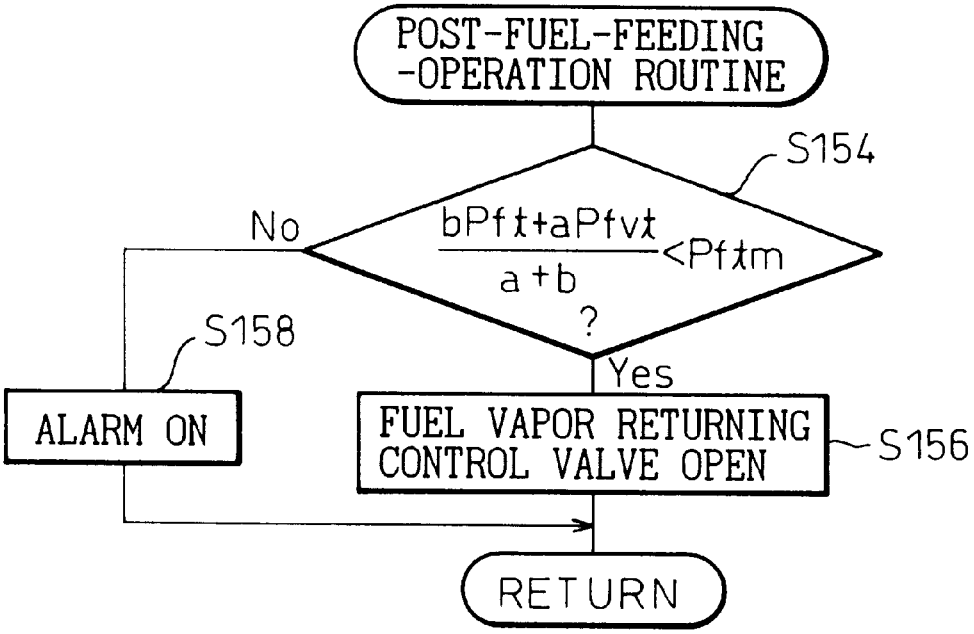
FIG. 5 is a flowchart of a post-fuel-feeding-operation process according to the first embodiment.

At step 130 in FIG. 4, it is judged if the pressure Pft in the fuel tank 5 sensed by the fuel tank pressure sensor 26 is higher than the atmospheric pressure Pa (Pft>Pa). When Pft>Pa, the routine proceeds to step 132. On the other hand, when Pft≦Pa, the routine proceeds to step 146 where the fuel vapor feeding control valve 34 is closed, the routine proceeds to step 148 where the compressor 35 is stopped, and the routine proceeds to step 138.

At step 132, it is judged if the pressure Pfvt in the fuel vapor tank 29 sensed by the fuel vapor tank pressure sensor 38 is lower than the predetermined fuel vapor tank pressure Pfvtm (Pfvt<Pfvtm). When Pfvt<Pfvtm, the routine proceeds to step 134 where the compressor 35 is activated, the routine proceeds to step 136 where the fuel vapor feeding control valve 34 is opened, and the routine proceeds to step 138. On the other hand, when Pfvt≧Pfvtm, the routine proceeds to step 140 where the fuel vapor feeding control valve is closed, the routine proceeds to step 142 where the compressor 35 is stopped, the routine proceeds to step 144 where the alarm 51 is switched on, and the routine is ended.

At step 138, it is judged if the closure 14 is open. When the closure 14 is open, the routine is ended. On the other hand, when the closure 14 is closed, it is judged that the feeding of the fuel is completed, the routine proceeds to step 150 where the fuel vapor feeding control valve 34 is closed, the routine proceeds to step 152 where the compressor 35 is stopped, the routine proceeds to step 154 where the fuel feeding flag is set, and the routine is ended.

The post-fuel-feeding-operation process according to the first embodiment of the invention will be explained in more detail, referring to a flowchart of FIG. 5, At step 154, it is judged if the resulting pressure in the fuel tank 5 would be lower than a predetermined fuel tank pressure Pftm ((b×Pft+a×Pfvt)/(a+b)<Pftm) where a is the volume of the upper space 27, b is the volume of the fuel vapor tank 29, Pft is the pressure in the fuel tank 5 sensed by the fuel tank pressure sensor 26, and Pfvt is the pressure in the fuel vapor tank 29 sensed by the fuel vapor tank pressure sensor 38. The predetermined fuel tank pressure Pftm is lower than an acceptable pressure which the fuel tank 5 can withstand. At step 154, when (b×Pft+a×Pfvt)/(a+b)<Pftm, the routine proceeds to step 156 where the fuel vapor returning control valve 30 is opened, and the routine is ended. On the other hand, when (b×Pft+a×Pfvt)/(a+b)≧Pftm, it is judged that the fuel vapor returning valve 30 should not be opened, the routine proceeds to step 158 where the alarm 51 is switched on, and the routine is ended.

A fuel reserving device according to the second embodiment of the invention will be explained below.

In the first embodiment, the fuel vapor returning control valve is kept closed until it is judged that the resulting pressure in the fuel tank would be lower than the predetermined fuel tank pressure. Therefore, if the resulting pressure in the fuel tank does not become lower than the predetermined fuel tank pressure, the fuel vapor could be in the fuel vapor tank and not be consumed for long time. The second embodiment solves this problem.

The components of the fuel reserving device and the fuel feeding operation of the second embodiment are the same as those of the first embodiment. Therefore, the explanations thereof will be eliminated.

A post-fuel-feeding-operation process according to the second embodiment of the invention will be explained below.

In the second embodiment, when it is judged that the resulting pressure in the fuel tank 5 would be higher than the predetermined fuel tank pressure, the fuel vapor is purged from the fuel vapor tank to the intake passage 2 to decrease the pressure in the fuel vapor tank 29. Therefore, according to the second embodiment, the fuel vapor returning control valve 30 can be opened to return the fuel vapor from the fuel vapor tank 29 to the fuel tank 5.

Figure 6:
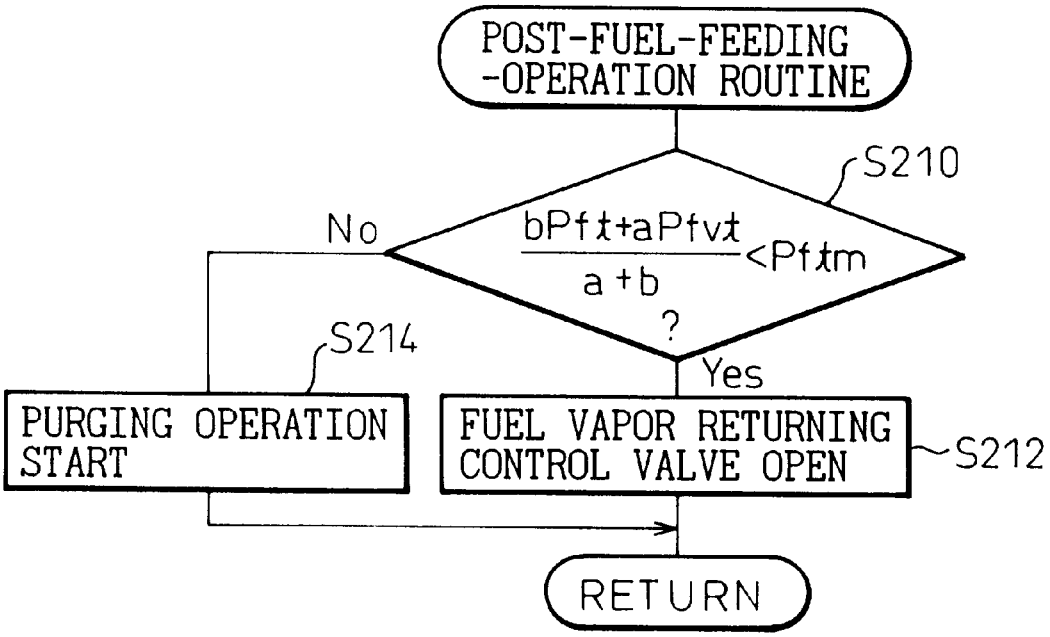
FIG. 6 is a flowchart of a post-fuel-feeding-operation process according to the second embodiment of the invention.

The post-fuel-feeding-operation process according to tho second embodiment of the invention will be explained in more detail, referring to a flowchart of FIG. 6.

At step 210, it is judged if the resulting pressure in the fuel tank 5 would be lower than the predetermined fuel tank pressure Pftm ((b×Pft+a×Pfvt)/(a+b)<Pftm) where a is the volume of the upper space 27, b is the volume of the fuel vapor tank 29, Pft is the pressure in the fuel tank 5 sensed by the fuel tank pressure sensor 26, and Pfvt is the pressure in the fuel vapor tank 29 sensed by the fuel vapor tank pressure sensor 38. When (b×Pft+a×Pfvt)/(a+b)<Pftm, the routine proceeds to step 212 where the fuel vapor returning control valve 30 is opened, and the routine is ended. On the other hand, when (b×Pft+a×Pfvt)/(a+b)≧Pftm, the routine proceeds to step 214 where the fuel vapor is purged from the fuel vapor tank 29 to the intake passage 2, and the routine is ended.

A fuel reserving device according to the third embodiment of the invention will be explained below.

Figure 7:
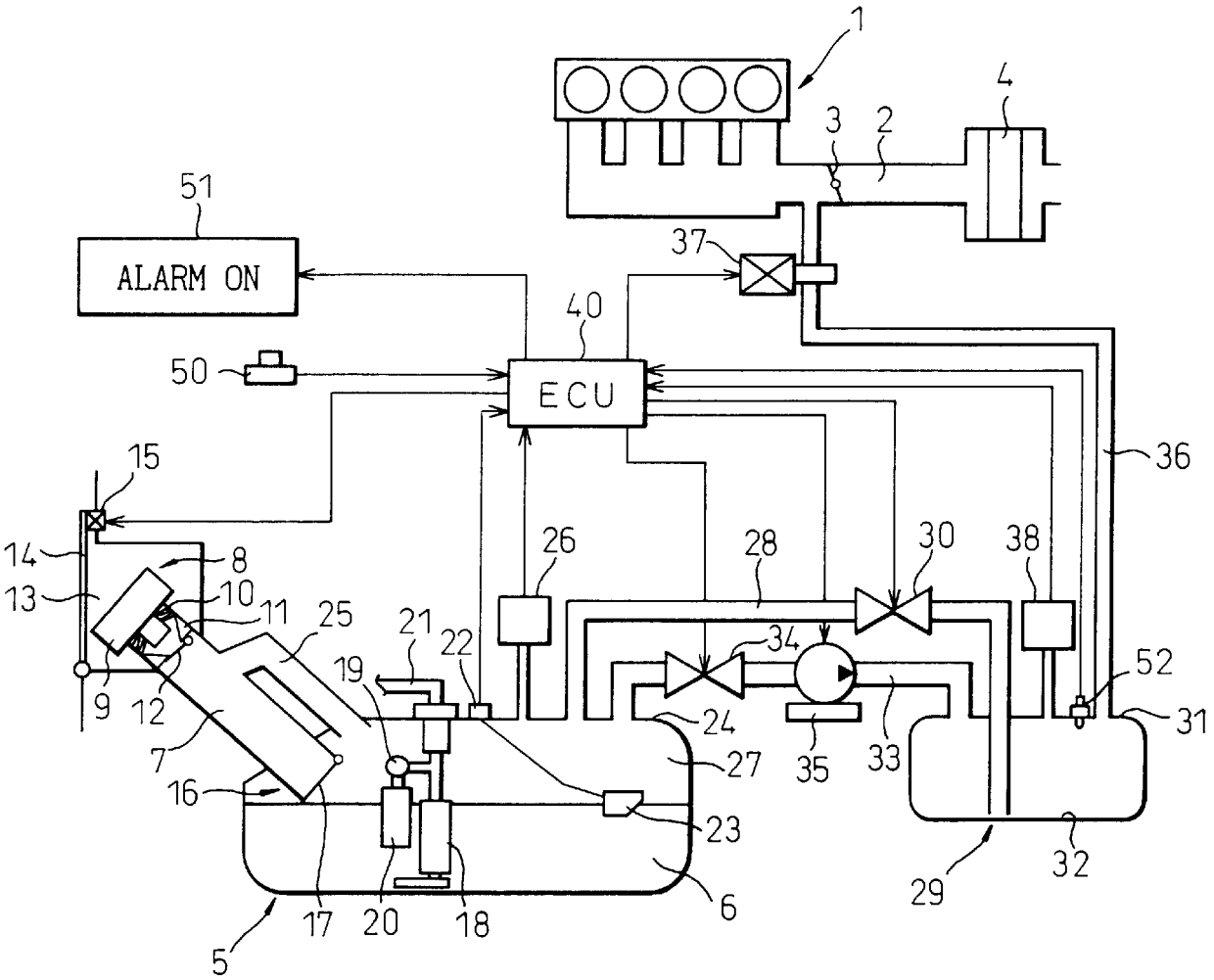
FIG. 7 is a view of a fuel reserving device according to the third embodiment of the invention.

Referring to FIG. 7, a temperature sensor 52 is arranged on the upper wall 31 of the fuel vapor tank 29 to sense the temperature in the fuel vapor tank 29. The temperature sensor 52 is connected to the ECU 40.

Figure 8:
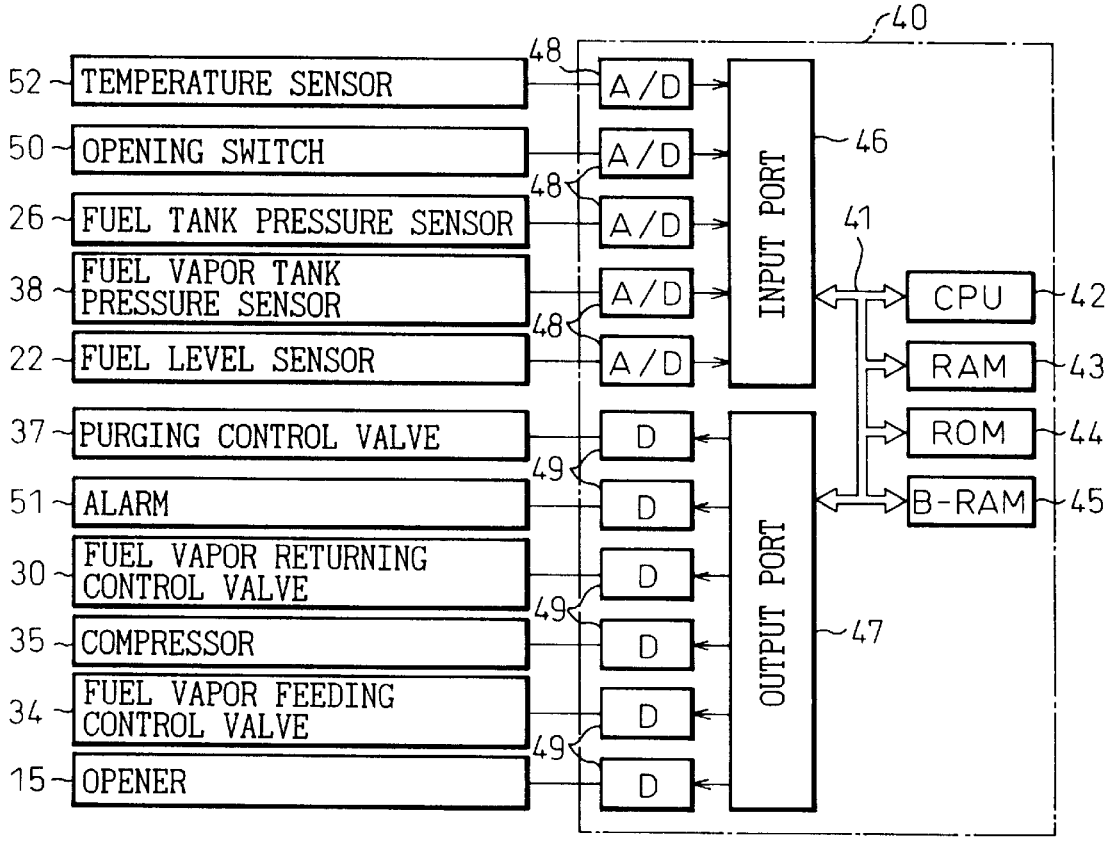
FIG. 8 is a view of the ECU of FIG. 7.

Referring to FIG. 8, the temperature sensor 52 is connected to the input port 46 via a corresponding A-D converter 48.

The components of the fuel reserving device other than the temperature sensor and the fuel feeding operation of the third embodiment are the same as those of the first embodiment. Therefore, the explanations thereof will be eliminated.

A post-fuel-feeding-operation process according to the third embodiment of the invention will be explained below.

If a temperature in the fuel vapor tank 29 is decreased to a predetermined temperature for a predetermined time, the pressure in the fuel vapor tank 29 is decreased.

Therefore, in the third embodiment, when it is judged that the resulting pressure in the fuel tank 5 would be higher than the predetermined fuel tank pressure, it is judged if the temperature in the fuel vapor tank 29 is lower than a predetermined temperature. The predetermined temperature is higher than the temperature of the atmosphere and is set as a temperature which can be naturally decreased to a certain low temperature for a predetermined time.

When the temperature in the fuel vapor tank 29 is equal to or higher than the predetermined temperature, it is judged that the temperature in the fuel vapor tank 29 can be naturally decreased by a certain temperature. When it is judged that the resulting pressure would be lower than the predetermined fuel tank pressure after the predetermined time has elapsed, the fuel vapor returning control valve 30 is opened to return the fuel vapor from the fuel vapor tank 29 to the fuel tank 5.

According to the third embodiment, the opportunity to open the fuel vapor returning control valve 30 is increased.

Figure 9:
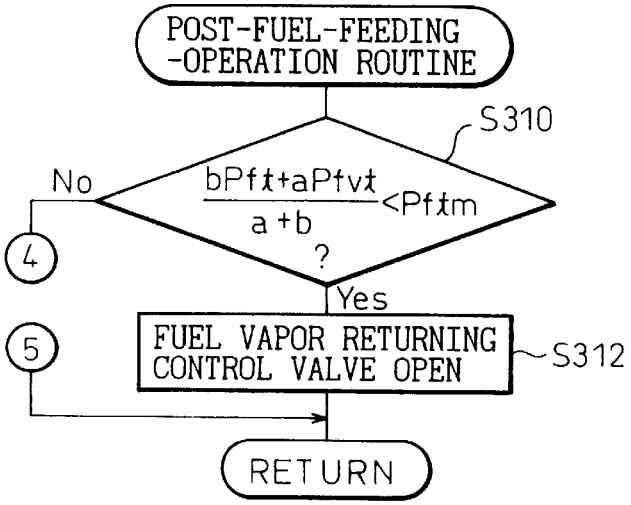
FIG. 9 is a part of a flowchart of a post-fuel-feeding-operation process according to the third embodiment.
Figure 10:
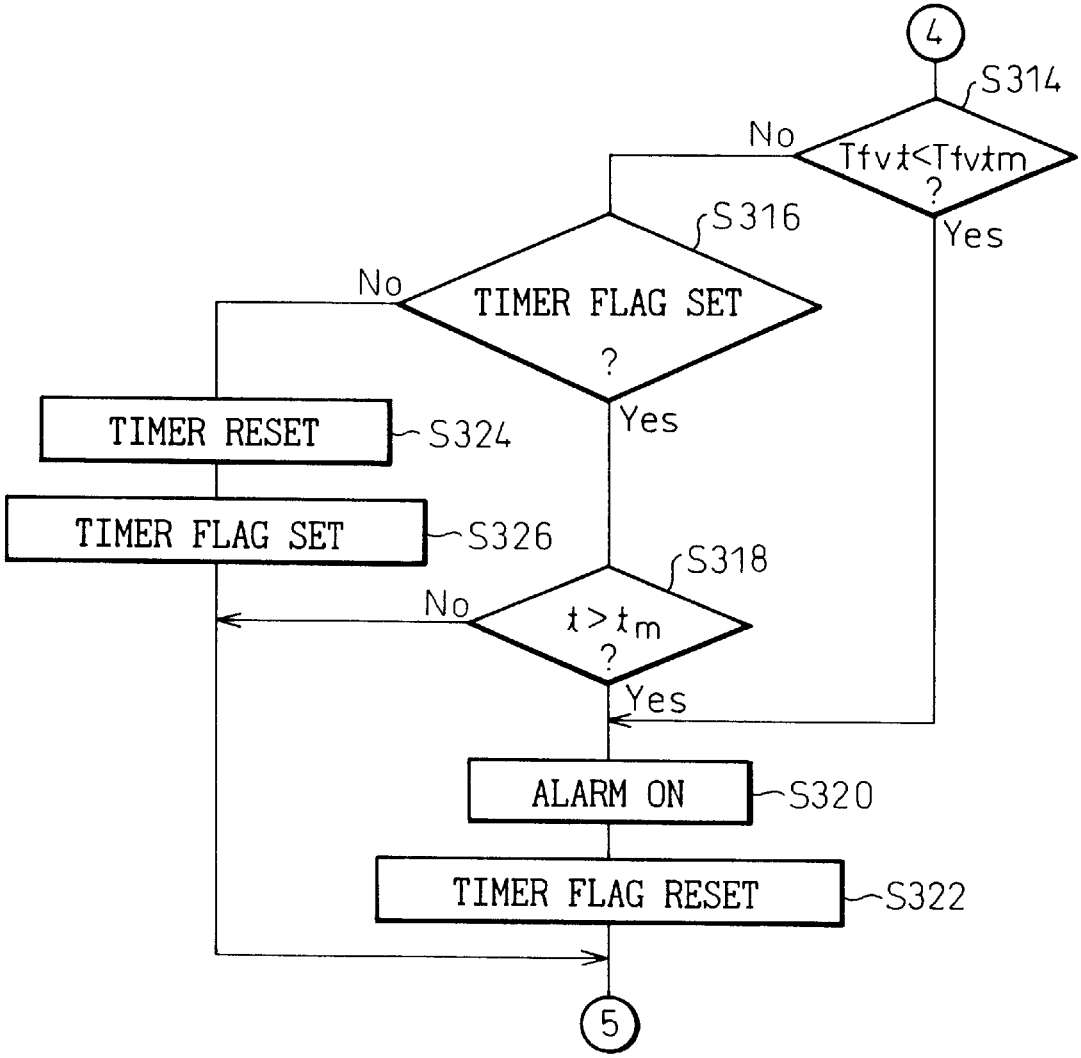
FIG. 10 is a part of a flowchart of a post-fuel-feeding-operation process according to the third embodiment.

The post-fuel-feeding-operation process according to the third embodiment of the invention will be explained in more detail, referring to a flowchart of FIGS. 9 and 10.

At step 310, it is judged if the resulting pressure in the fuel tank 5 would be lower than the predetermined fuel tank pressure Pftm ((b×Pft+a×Pfvt)/(a+b)<Pftm) where a is the volume of the upper space 27, b is the volume of the fuel vapor tank 29, Pft is the pressure in the fuel tank 5 sensed by the fuel tank pressure sensor 26, and Pfvt is the pressure in the fuel vapor tank 29 sensed by the fuel vapor tank pressure sensor 38. When (b×Pft+a×Pfvt)/(a+b)<Pftm, the routine proceeds to step 312 where the fuel vapor returning control valve 30 is opened, and the routine is ended. On the other hand, when (b×Pft+a×Pfvt)/(a+b)≧Pftm, the routine proceeds to step 314 in FIG. 10.

At step 314, it is judged if the temperature Tfvt in the fuel vapor tank 29 sensed by the temperature sensor 52 is lower than a predetermined temperature Tfvtm (Tfvt<Tfvtm). The predetermined temperature is higher than the temperature of the atmosphere and is set as a temperature which can be naturally decreased to a certain low temperature for a predetermined time. When Tfvt<Tfvtm, it is judged that the temperature in the fuel vapor tank 29 would not ba decreased, the routine proceeds to step 320 where the alarm 51 is switched on, the routine proceeds to step 322 where a timer flag is reset, and the routine is ended. The timer flag is set when a timer is reset, and is reset when the timer counts the predetermined time. On the other hand, Tfvt≧Tfvtm, the routine proceeds to step 316.

At step 136, it is judged if the timer flag is set. When the timer flag is set, the routine proceeds to step 318. On the other hand, when the timer flag is reset, the routine proceeds to step 324 where the timer is reset, the routine proceeds to step 326 where the timer flag is set, and the routine is ended.

At step 318, a time t is larger than a predetermined time tm (t>tm). When t>tm, the routine proceeds to step 320 where the alarm. 51 is switched on, the routine proceeds to step 322 where a timer flag is reset, and the routine is ended. On the other hand, when t≦tm, the routine is ended.

A fuel reserving device according to the fourth embodiment of the invention will be explained below.

In the third embodiment, it may take a long time until the temperature in the fuel vapor tank becomes sufficiently low. According to the fourth embodiment, a time until the temperature in the fuel vapor tank becomes sufficiently low is reduced.

Figure 11:
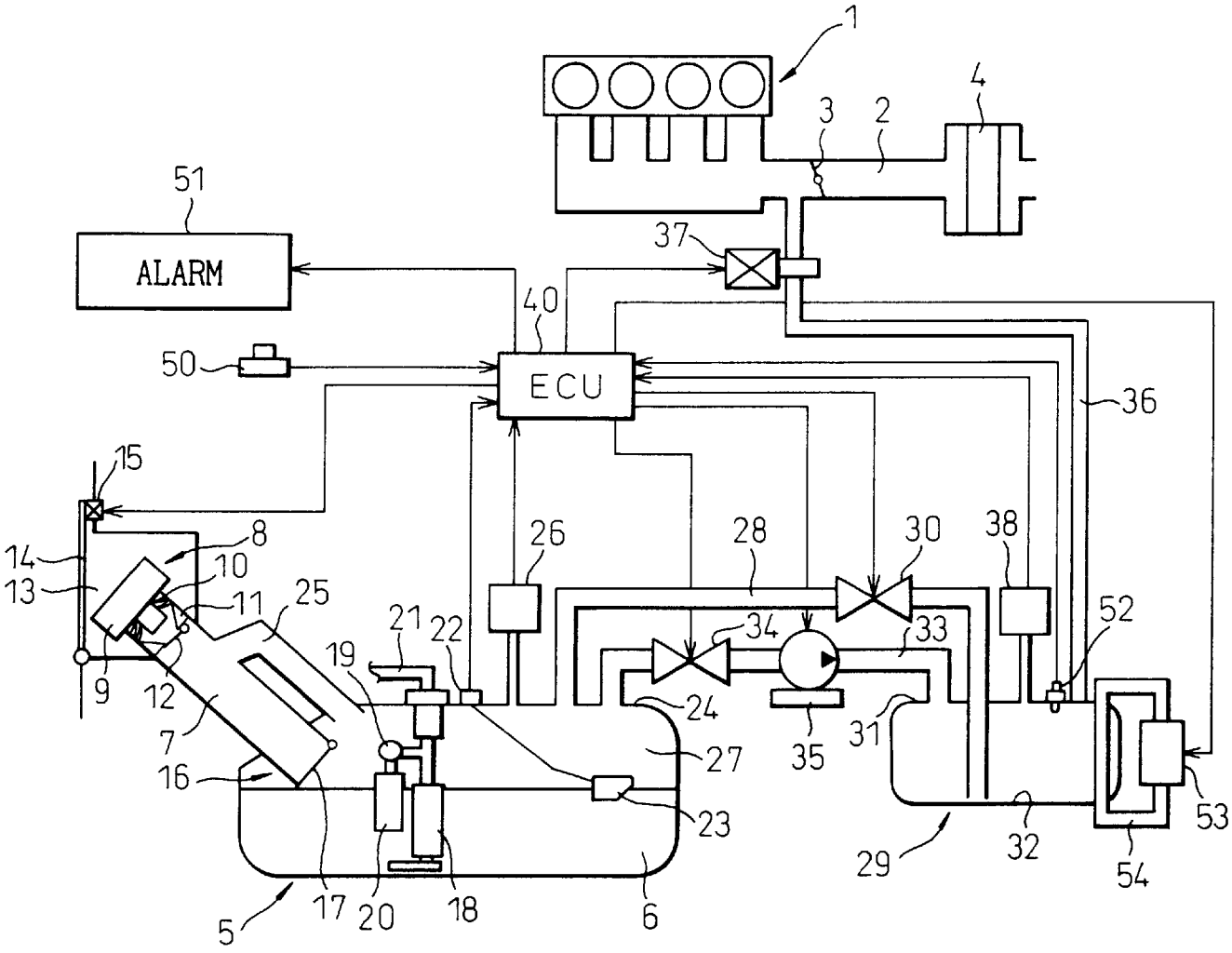
FIG. 11 is a view of a fuel reserving device according to the fourth embodiment of the invention.

Referring to FIG. 11, the fuel reserving device according to the fourth embodiment comprises a cooling device 53 for cooling the fuel vapor tank 29. The cooling device 53 has a cooling water pipe 54. The cooling water pipe 54 passes through the fuel vapor tank 29. The cooling device 53 is connected to the ECU 40.

Figure 12:
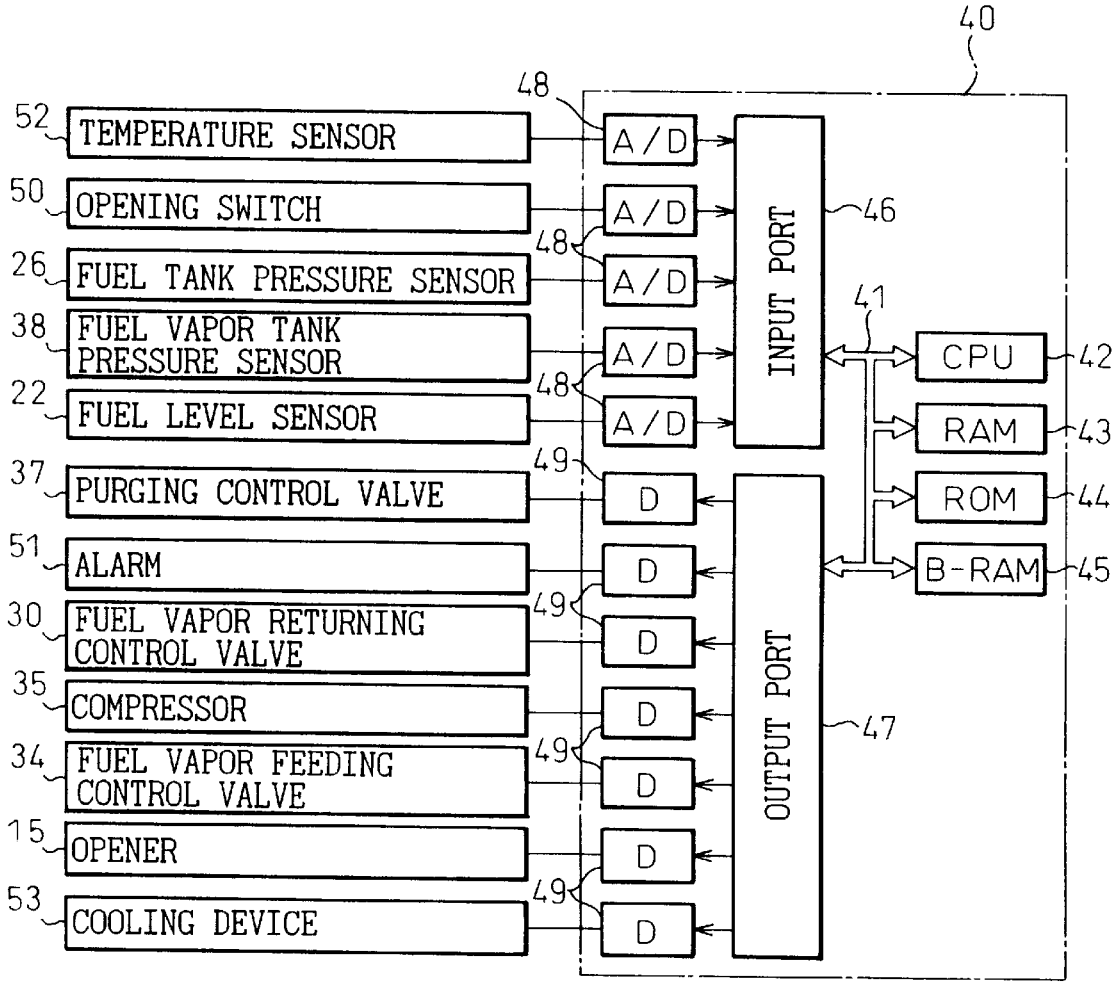
FIG. 12 is a view of the ECU of FIG. 11.

Referring to FIG. 12, the cooling device 53 is connected to the output port 47 via a corresponding drive 49.

The components of the fuel reserving device other than the cooling device and the fuel feeding operation of the third embodiment are the same as those of the third embodiment. Therefore, the explanations thereof will be eliminated.

A post-fuel-feeding-operation process according to the fourth embodiment of the invention will be explained below.

In the fourth embodiment, when it is judged that the resulting pressure in the fuel tank 5 would be higher than the predetermined fuel tank pressure, it is judged if the temperature in the fuel vapor tank 29 is lower than the predetermined temperature.

When the temperature in the fuel vapor tank 29 is equal to or higher than the predetermined temperature, it is judged that the temperature in the fuel vapor tank 29 can be decreased by a certain temperature by the cooling device 53. Therefore, the cooling device 53 is activated to cool the fuel vapor tank 29. When the resulting pressure is lower than the predetermined fuel tank pressure, the fuel vapor returning control valve 30 is opened.

According to the fourth embodiment, the fuel vapor returning control valve 30 can be opened earlier than the third embodiment.

In the fourth embodiment, a cooling device using an air may be employed. Further, the fuel tank can be cooled by a cooling device.

Figure 13:
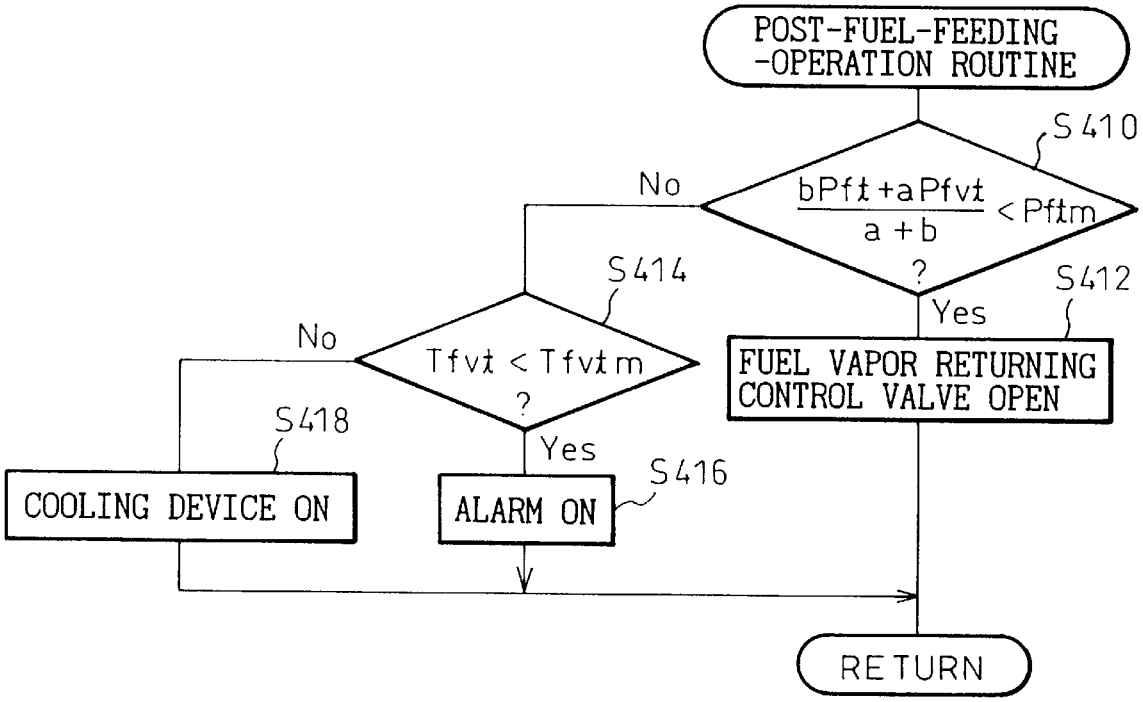
FIG. 13 in a flowchart of a post-fuel-feeding-operation process according to the fourth embodiment.

The post-fuel-feeding-operation process according to the fourth embodiment of the invention will be explained in more detail, referring to a flowchart of FIG. 13.

At step 410, it is judged if the resulting pressure in the fuel tank 5 would be lower than the predetermined fuel tank pressure Pftm ((b×Pft+a×Pfvt)/(a+b)<Pftm) where a is the volume of the upper space 27, b is the volume of the fuel vapor tank 29, Pft is the pressure in the fuel tank 5 sensed by the fuel tank pressure sensor 26, and Pfvt is the pressure in the fuel vapor tank 29 sensed by the fuel vapor tank pressure sensor 38. When (b×Pft+a×Pfvt)/(a+b)<Pftm, the routine proceeds to step 412 where the fuel vapor returning control valve 30 is opened, and the routine is ended. On the other hand, when (b×Pft+a×Pfvt)/(a+b)≧Pftm, the routine proceeds to step 414.

At step 414, it is judged if the temperature Tfvt in the fuel vapor tank 29 sensed by the temperature sensor 52 is lower than the predetermined temperature Tfvtm (Tfvt<Tfvtm). When Tfvt<Tfvtm, the routine proceeds to step 416 where the alarm 51 is switched on, and the routine is ended. On the other hand, Tfvt≧Tfvtm, the routine proceeds to step 418 where the cooling device 53 is activated, and the routine is ended.

A fuel reserving device according to the fifth embodiment of the invention will be explained below.

In the fuel reserving device according to the first to fourth embodiments, the fuel vapor may be liquidized in the fuel vapor tank 29. The fuel in the reservoir 29 decreases the volume of the fuel vapor tank 29. Therefore, the possible amount of the fuel vapor fed from the fuel tank 5 to the fuel vapor tank 29 is decreased. Further, the fuel in the fuel vapor tank 29 may be evaporated by the fuel vapor having a high temperature which is fed from the fuel tank 5 to the fuel vapor tank 29 and by the increasing of the temperature of the fuel vapor tank 29. The evaporated fuel increases the pressure in the fuel vapor tank 29. Therefore, the fuel vapor tank 29 needs a high durability. According to the fifth embodiment, the fuel in the fuel vapor tank is discharged from the fuel vapor tank 29 to overcome the above problems.

Figure 14:
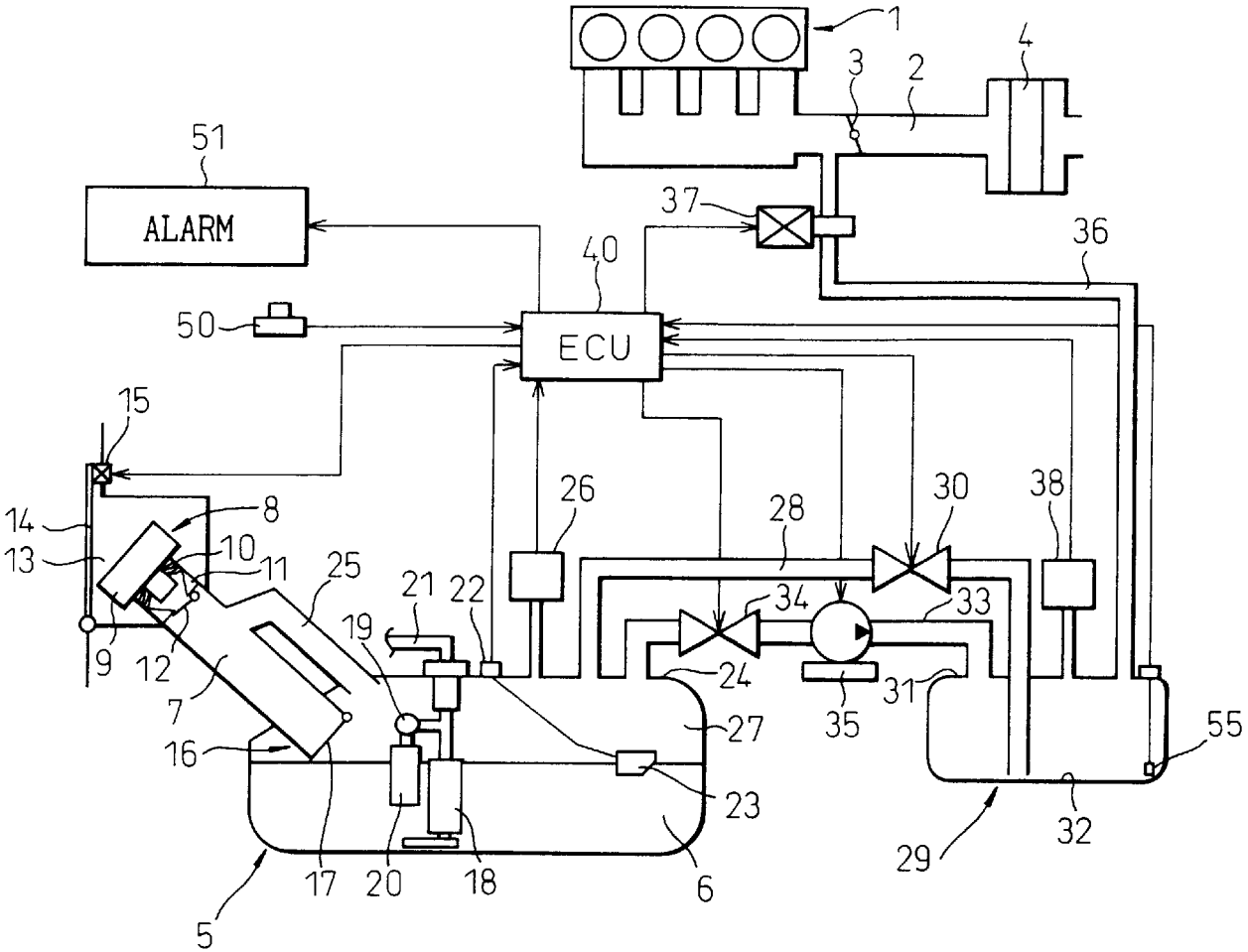
FIG. 14 is a view of a fuel reserving device according to the fifth embodiment of the invention.

Referring to FIG. 14, a fuel sensor 55 is arranged on the fuel vapor tank 29 to sense the fuel in the fuel vapor tank 29. The fuel sensor 55 is connected to the ECU 40.

Figure 15:
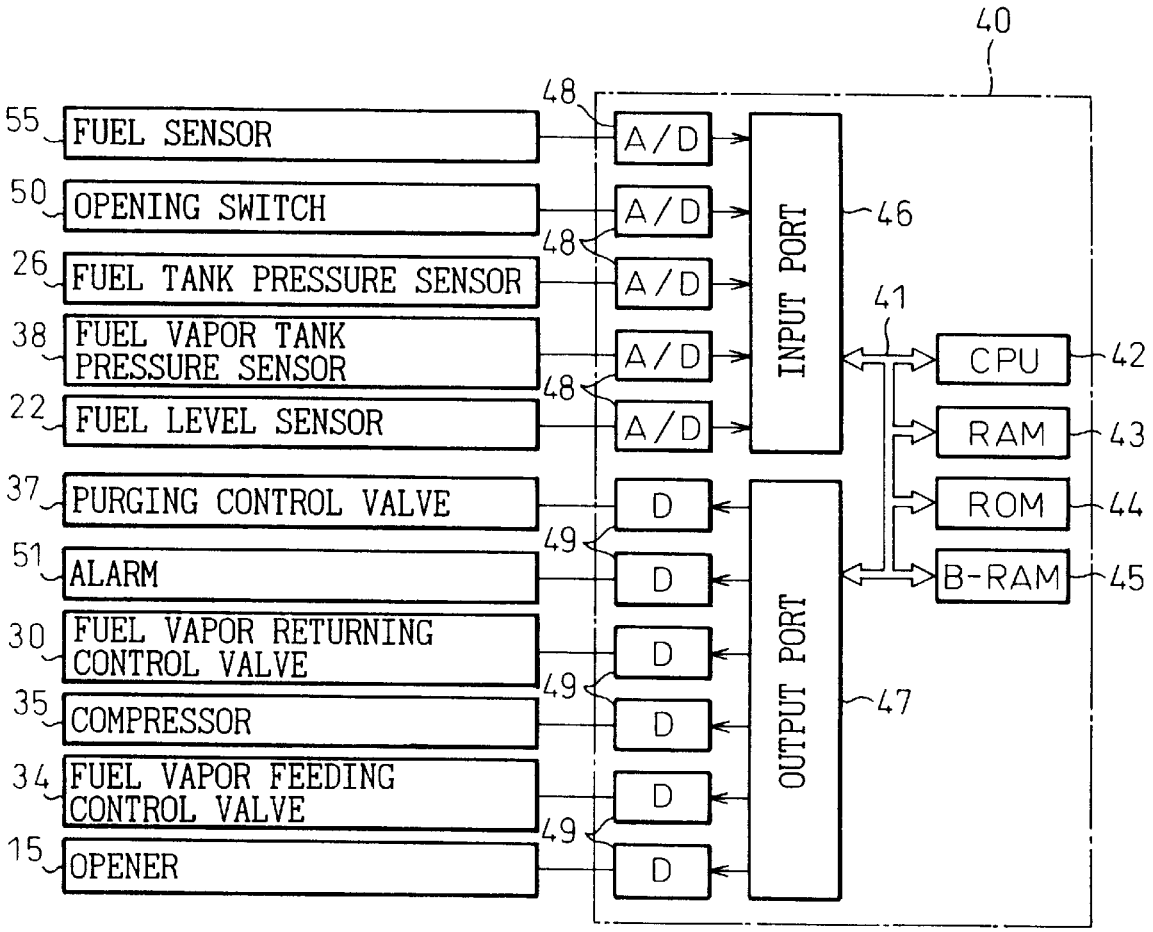
FIG. 15 is a view of the ECU of FIG. 14.

Referring to FIG. 15, the fuel sensor 55 is connected to the input port 46 via a corresponding A-D converter 48.

The components of the fuel reserving device other than the fuel sensor and the fuel feeding operation of the fifth embodiment are the same as those of the first embodiment. Therefore, the explanations thereof will be eliminated.

A post-fuel-feeding-operation process according to the fifth embodiment of the invention will be explained below.

In the fifth embodiment, when it is judged that the resulting pressure in the fuel tank 5 would be lower than the predetermined fuel tank pressure, it is judged if the fuel sensor 55 senses any fuel in the fuel vapor tank 29. When the fuel sensor 55 senses any fuel in the fuel vapor tank 29, it is nudged if the pressure in the fuel vapor tank 29 is higher than that in the fuel tank 5.

When the pressure in the fuel vapor tank 29 is higher than that in the fuel tank 5, the fuel vapor returning control valve 30 is opened. The high pressure in the fuel vapor tank 29 returns the fuel from the fuel vapor tank 29 to the fuel tank 5.

Figure 16:
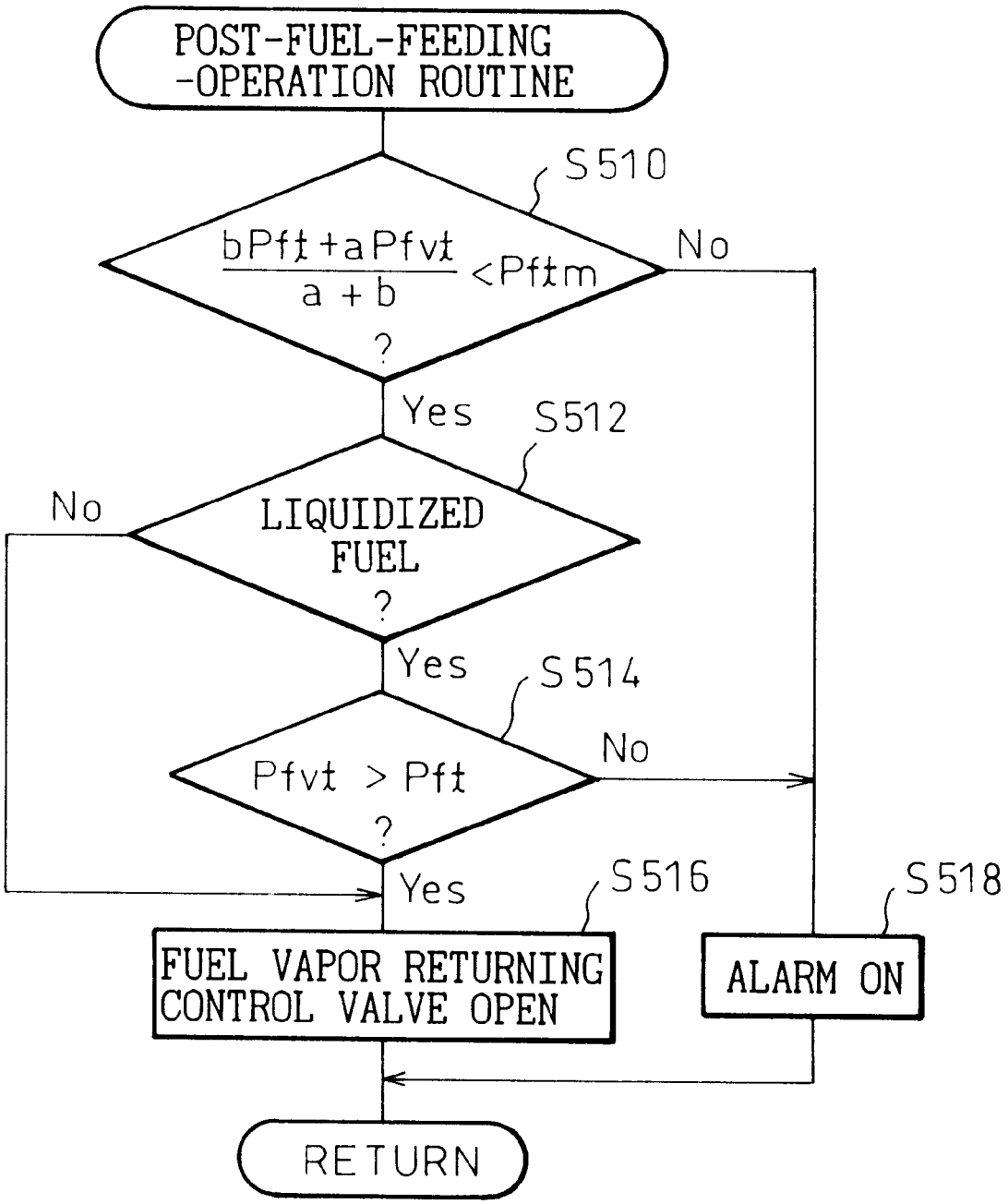
FIG. 16 is a flowchart of a post-fuel-feeding-operation process according to the fifth embodiment.

The post-fuel-feeding-operation process according to the fifth embodiment will be explained, referring to a flowchart of FIG. 16.

At step 510, it is judged if the resulting pressure in the fuel tank 5 would be lower than the predetermined fuel tank pressure Pftm ((b×Pft+a×Pfvt)/(a+b)<Pftm) where a is the volume of the upper space 27, b is the volume of the fuel vapor tank 29, Pft is the pressure in the fuel tank 5 sensed by the fuel tank pressure sensor 26, and Pfvt is the pressure in the fuel vapor tank 29 sensed by the fuel vapor tank pressure sensor 38. When (b×Pft+a×Pfvt)/(a+b)<Pftm, the routine proceeds to step 512. On the other hand, when (b×Pft+a×Pfvt)/(a+b)≧Pftm, the routine proceeds to step 414 where the alarm 51 is switched on, and the routine is ended.

At step 512, it is judged if the fuel sensor 55 senses any fuel in the fuel vapor tank 29. When the fuel sensor 55 senses any fuel in the fuel vapor tank 29, the routine proceeds to step 514. On the other hand, when the fuel sensor 55 senses no fuel in the fuel vapor tank 29, the routine proceeds to step 516 where the fuel vapor returning control valve 30 is opened, and the routine is ended.

At step 514, it is judged if the pressure Pfvt in the fuel vapor tank 29 sensed by the fuel vapor tank pressure sensor 38 is higher than the pressure Pft in the fuel tank 5 sensed by the fuel tank pressure sensor 26 (Pfvt>Pft). When Pfvt>Pft, the routine proceeds to step 516 where the fuel vapor returning control valve 30 is opened to return the fuel from the fuel vapor 29 to the fuel tank 5, and the routine is ended. On the other hand, when Pfvt≦Pft, it is judged that the fuel cannot be returned from the fuel vapor tank 29 to the fuel tank 5, the routine proceeds to step 518 where the alarm 51 is switched on, and the routine is ended.

A fuel reserving device according to the sixth embodiment will be explained below.

In the fuel reserving device according to the fifth embodiment, the fuel in the fuel vapor tank is not returned to the fuel tank until the pressure in the fuel vapor tank becomes higher than the pressure in the fuel tank. Therefore, according to the sixth embodiment, the opportunities for the fuel in the fuel vapor tank to be returned to the fuel tank will be increased.

The components of the fuel reserving device and the fuel feeding operation of the sixth embodiment are the same as those of the first embodiment. Therefore, the explanations thereof will be eliminated.

A post-fuel-feeding-operation process according to the sixth embodiment will be explained below.

In the sixth embodiment, when it is judged that the fuel sensor 55 senses any fuel in the fuel vapor tank 29 and the pressure in the fuel vapor tank 29 is lower than the pressure in the fuel tank 5, the compressor 35 is activated to increase the pressure in the fuel vapor tank 29. Therefore, according to the sixth embodiment, the opportunities for the fuel in the fuel vapor tank to be returned to the fuel tank are increased.

In the sixth embodiment, when it is judged that the fuel sensor 55 senses any fuel in the fuel vapor tank 29 and the pressure in the fuel vapor tank 29 is lower than the pressure in the fuel tank 5, the pressure in the fuel tank 5 may be decreased.

Figure 17:
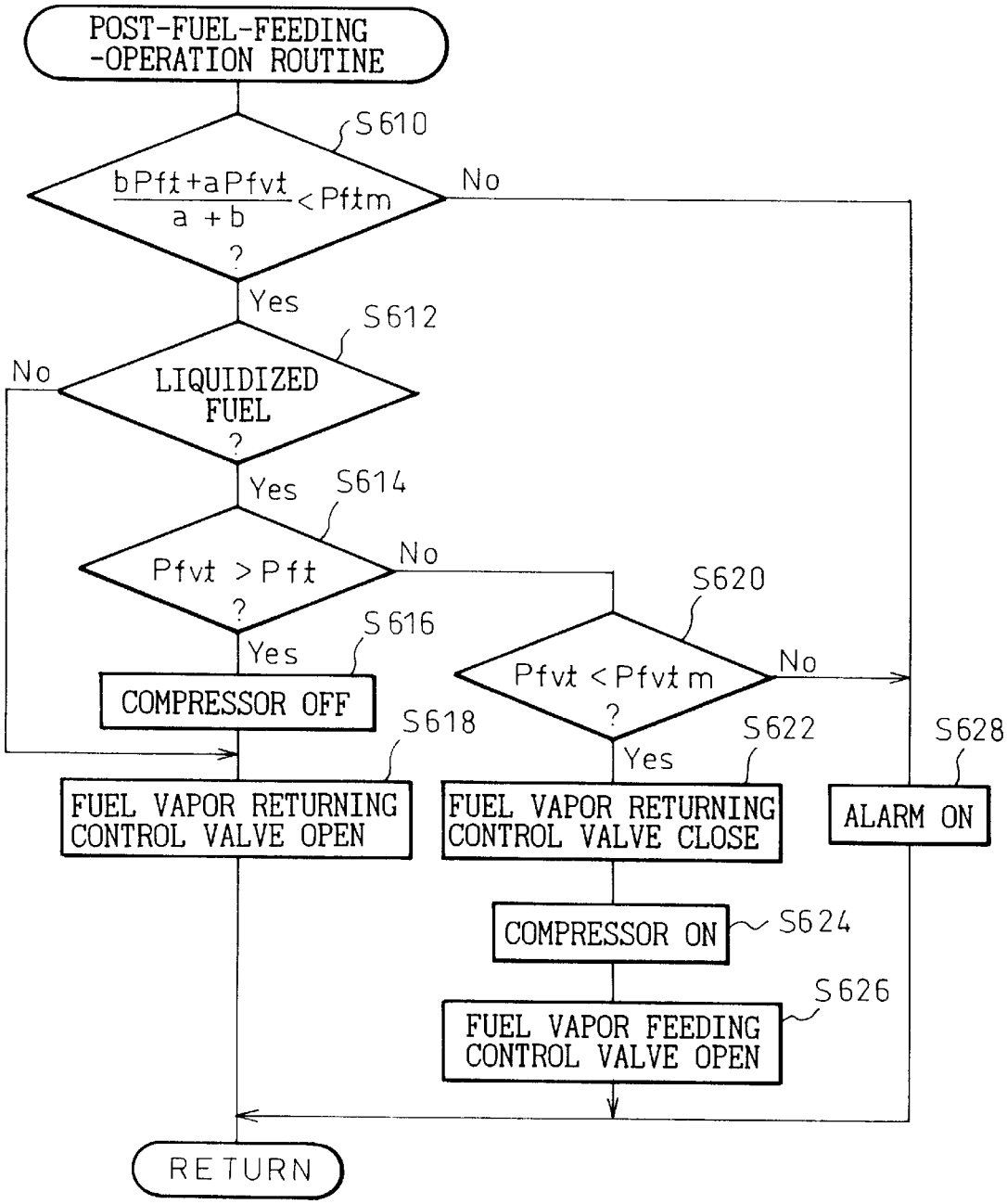
FIG. 17 is a flowchart of a post-fuel-feeding-operation process according to the sixth embodiment.

The post-fuel-feeding-operation process according to the sixth embodiment of the invention will be explained in more detail, referring to a flowchart of FIG. 17.

At step 610, it is judged if the resulting pressure in the fuel tank 5 would be lower than the predetermined fuel tank pressure Pftm ($(b\times Pft+a\times Pfvt)/(a+b)<Pftm$) where a is the volume of the upper space 27, b is the volume of the fuel vapor tank 29, Pft is the pressure in the fuel tank 5 sensed by the fuel tank pressure sensor 26, and Pfvt is the pressure in the fuel vapor tank 29 sensed by the fuel vapor tank pressure sensor 38. When $(b\times Pft+a\times Pfvt)/(a+b)<Pftm$, the routine proceeds to step 612. On the other hand, when $(b\times Pft+a\times Pfvt)/(a+b)\geqq Pftm$, the routine proceeds to step 628 where the alarm 51 is switched on, and the routine is ended.

At step 612, it is judged if the fuel sensor 55 senses any fuel in the fuel vapor tank 29. When the fuel sensor 55 senses any fuel in the fuel vapor tank 29, the routine proceeds to step 614. On the other hand, when the fuel sensor 55 senses no fuel in the fuel vapor tank 29, the routine proceeds to step 618 where the fuel vapor returning control valve 30 is opened, and the routine is ended.

At step 614, it is judged if the pressure Pfvt in the fuel vapor tank 29 sensed by the fuel vapor tank pressure sensor 38 is higher than the pressure Pft in the fuel tank 5 sensed by the fuel tank pressure sensor 26 ($Pfvt>Pft$). When $Pfvt>Pft$, the routine proceeds to step 616 where the compressor 35 is activated to increase the pressure in the fuel vapor tank 29, and the routine proceeds to step 618 where the fuel vapor returning control valve 30 is opened to return the fuel from the fuel vapor tank 29 to the fuel tank 5, and the routine is ended. On the other hand, when $Pfvt\geqq Pft$, the routine proceeds to step 620.

At step 620, it is judged if the pressure Pfvt in the fuel vapor tank 29 is lower than the predetermined fuel vapor tank pressure Pfvtm ($Pfvt<Pfvtm$). When $Pfvt<Pfvtm$, the routine proceeds to step 622 where the fuel vapor returning control valve 30 is closed to seal the fuel vapor tank 29, the routine proceeds to step 624 where the compressor 35 is activated, the routine proceeds to step 626 where the fuel vapor feeding control valve 34 is opened to increase the pressure in the fuel vapor tank 29, and the routine is ended. On the other hand, when $Pfvt\leqq Pfvtm$, the routine proceeds to step 628 where the alarm 51 is switched on, and the routine is ended.

While the invention has been described by reference to specific embodiments chosen for purposes of illustration, it should be apparent that numerous modifications can be made thereto by those skilled in the art without departing from the basic concept and scope of the invention.

We claim:

1. A fuel reserving device for reserving fuel therein comprising:

a fuel tank for reserving fuel therein, a fuel vapor tank for reserving fuel vapor therein, fuel vapor feeding means for feeding the fuel vapor from said fuel tank to said fuel vapor tank, fuel vapor returning means for returning the fuel vapor from said fuel vapor tank to said fueltank, and control means for controlling an operation of said fuel vapor returning means to stop returning the fuel vapor from said fuel vapor tank to said fuel tank when said control means judges that a pressure in said fuel tank would be higher than a predetermined pressure if said fuel vapor returning means returned the fuel vapor from said fuel vapor tank to said fuel tank.

2. A fuel reserving device according to claim 1, wherein said control means controls an operation of said fuel vapor feeding means to feed the fuel vapor from said fuel tank to said fuel vapor tank when the fuel vapor should be fed from said fuel tank to said fuel vapor tank, and an operation of said fuel vapor returning means to return the fuel vapor from said fuel vapor tank to said fuel tank when the fuel vapor should be returned from said fuel vapor tank to said fuel tank.

3. A fuel reserving device according to claim 2, wherein said control means makes said fuel vapor feeding means feed the fuel vapor from said fuel tank to said fuel vapor tank when the fuel is fed to said fuel tank, and makes said fuel vapor returning means return the fuel vapor from said fuel vapor tank to said fuel tank when the fuel is completed to be fed to said fuel tank.

4. A fuel reserving device according to claim 3, wherein said fuel vapor feeding means comprises a fuel vapor feeding pipe for connecting said fuel tank to said fuel vapor tank and a fuel vapor feeding control valve arranged in said fuel vapor feeding pipe, said fuel vapor returning means comprises a fuel vapor returning pipe for connecting said fuel vapor tank to said fuel tank and a fuel vapor returning control valve arranged in said fuel vapor returning pipe, and said control means opens said fuel vapor feeding control valve and closes said fuel vapor returning control valve when fuel is fed to said fuel tank, and closes said fuel vapor feeding control valve and opens said fuel vapor returning control valve when the fuel has been fed to said fuel tank.

5. A fuel reserving device according to claim 4, wherein said fuel vapor feeding means comprises a compressor arranged in said fuel vapor feeding pipe to feed the fuel vapor from said fuel tank to said fuel vapor tank under a pressure.

6. A fuel reserving device according to claim 1, wherein pressure sensing means is provided for sensing at least one of the pressures in said fuel tank and said fuel vapor tank, and said control means judges that the pressure in said fuel tank would be higher than said predetermined pressure if said fuel vapor returning means returned the fuel vapor from said fuel vapor tank to said fuel tank on the basis of the pressure sensed by said pressure sensing means.

7. A fuel reserving device according to claim 6, wherein said pressure sensing means comprises a fuel tank pressure sensor for sensing the pressure in said fuel tank and a fuel vapor tank pressure sensor for sensing the pressure in said fuel vapor tank.

8. A fuel reserving device according to claim 6, wherein fuel sensing means is provided for sensing the fuel in said fuel vapor tank, said fuel vapor returning means returns the fuel vapor in said fuel vapor tank to said fuel tank when said fuel sensing means senses fuel in said fuel vapor tank and said pressure sensing means senses that the pressure in said fuel vapor tank is higher than the pressure in said fuel tank.

9. A fuel reserving device according to claim 8, wherein pressure increasing means is provided for increasing the pressure in said fuel vapor tank when said fuel sensing means senses the fuel in said fuel vapor tank and said pressure sensing means senses that the pressure in said fuel vapor tank is lower than the pressure in said fuel tank.

10. A fuel reserving device according to claim 8, wherein temperature increasing means is provided for increasing the temperature in said fuel vapor tank when said fuel sensing means senses the fuel in said fuel vapor tank and said pressure sensing means senses that the pressure in said fuel vapor tank is lower than the pressure in said fuel tank.

11. A fuel reserving device according to claim 1, wherein cooling means is provided for cooling at least one of said fuel vapor tank and said fuel tank when said control means judges that the pressure in said fuel tank would be higher than said predetermined pressure if said fuel vapor returning means returned the fuel vapor from said fuel vapor tank to said fuel tank.

12. A fuel reserving device according to claim 1, wherein purging means is provided for purging the fuel vapor from said fuel vapor tank to an engine when said control means judges that the pressure in said fuel tank would be higher than said predetermined pressure if said fuel vapor returning means returned the fuel vapor from said fuel vapor tank to said fuel tank.

* * * * *